US006849175B2

(12) United States Patent
Kresnyak

(10) Patent No.: US 6,849,175 B2
(45) Date of Patent: Feb. 1, 2005

(54) METHOD OF REMOVING WATER AND CONTAMINANTS FROM CRUDE OIL CONTAINING SAME

(75) Inventor: Steve Kresnyak, Calgary (CA)

(73) Assignee: Colt Engineering Corporation, Calgary (CA)

( * ) Notice: Subject to any disclaimer, the term of this patent is extended or adjusted under 35 U.S.C. 154(b) by 0 days.

(21) Appl. No.: 10/011,319

(22) Filed: Dec. 11, 2001

(65) Prior Publication Data

US 2002/0079248 A1 Jun. 27, 2002

Related U.S. Application Data

(63) Continuation-in-part of application No. 09/604,577, filed on Jun. 27, 2000, now Pat. No. 6,372,123.

(51) Int. Cl.[7] ..... C10G 33/00
(52) U.S. Cl. ..... 208/187; 516/194
(58) Field of Search ..... 208/187; 516/194

(56) References Cited

U.S. PATENT DOCUMENTS 1,547,100 A * 7/1925 Daughdrill ..... 208/187
1,652,166 A * 12/1927 Dubbs ..... 208/187
1,656,710 A * 1/1928 Rudigier ..... 208/187
3,619,416 A * 11/1971 Hendry ..... 208/187
3,796,652 A * 3/1974 Lupul ..... 208/187
3,888,760 A * 6/1975 Ebert ..... 208/48
3,923,644 A * 12/1975 Hindman ..... 208/186
4,200,550 A * 4/1980 Scherrer et al. ..... 252/335
4,356,863 A * 11/1982 Furr ..... 165/1
4,789,461 A * 12/1988 Clare et al. ..... 208/187
4,806,231 A * 2/1989 Chirinos et al. ..... 208/251 R
4,968,410 A * 11/1990 Johnson, Sr. ..... 208/187
RE33,999 E * 7/1992 Clare et al. ..... 208/187
5,607,574 A * 3/1997 Hart ..... 208/188
5,951,868 A * 9/1999 Padron ..... 210/634
6,372,123 B1 * 4/2002 Kresnyak et al. ..... 208/187

* cited by examiner

*Primary Examiner*—Walter D. Griffin
(74) *Attorney, Agent, or Firm*—Paul S. Sharpe; Ogilvy Renault

(57) ABSTRACT

A method for contaminant and water removal from crude oil. The method involves recirculating at least a portion of the dewatered crude into a dehydrator. The dehydrator contains a heated dehydrated crude oil and the surface or adjacent thereto is maintained at a temperature sufficient to vaporize any water contacting the surface from crude oil to be treated in the dehydrator. It has been found important to maintain a substantially uniform temperature at or below the vaporizing surface in order to effectively treat crude oil for dewatering purposes. Significant temperature fluctuations are typically realized by dehydrators since heat enthalpy is removed in order to vaporize the water in the crude oil. Such fluctuations lead to process complications and upset and are therefore undesirable. The instant invention recognizes this limitation and substantially reduces foaming and provides for a smoothly running and efficient dehydration process.

14 Claims, 11 Drawing Sheets

METHOD OF REMOVING WATER AND CONTAMINANTS FROM CRUDE OIL CONTAINING SAME

This application is a continuation-in-part of application Ser. No. 09/604,577, filed on Jun. 27, 2000, now U.S. Pat. No. 6,372,123.

FIELD OF THE INVENTION

The present invention is directed to an enhanced crude oil dehydration process and apparatus, and more particularly the present invention is directed to a crude oil dehydration and decontamination process which can overcome the instability problems encountered with prior art for treating high water cut heavy oil streams, provide enhanced thermal energy input and recovery methods and remove suspended and dissolved compounds from inlet feed.

BACKGROUND OF THE INVENTION

Throughout many regions of the world, heavy oil, a hydrocarbon material having much higher viscosity or lower API gravity (less than 20° API, typically 7° to 12° API) than conventional petroleum crude, is being economically recovered for commercial sale. During the recovery process and prior to the transport to refineries for upgrading, the heavy oil receives preliminary treatment for water and solids removal to generally achieve basic sediment and water (BS & W) content less than 0.5% by volume and chloride content less than 30 ppm (wt). Water content of the treated heavy oil typically is required to be 0.3% by volume or less.

Conventional crude oil treatment methods were proven to be ineffective with respect to heavy oil until the advent of the technology set forth in U.S. Pat. Reissue No. 33,999, Clare et al., reissued Jul. 21, 1992 and Canadian Patent 1,302,937, Clare et al., reissued on Jun. 9, 1992. These patents describe a simple apparatus which can be located in remote oil producing areas for dehydrating heavy oil with low risk of foaming and unstable operating, while continuously achieving dry oil which exceeds requisite specifications. These dehydrators were found to be restricted to feed oil water content of less than 5% water cuts and susceptible to foaming and process instability during high water feed rates. Throughout the operation of several of these dehydrators known from practicing the technology in U.S. Pat. Nos. Re 33,999 and 1,302,937, areas for improvement were discovered to overcome the limitations of feed oil water content and unstable operation caused by pretreatment upsets.

Further, additional problems have been experienced with the prior art in that although dehydrated heavy oil is achieved, high concentrations of suspended solids, such as clay and silica and dissolved compounds such as chlorides remain in the treated oil. These undesirable compounds continue to create many problems in pipeline transportation systems and refinery facilities to the extent that they depreciate the commercial valve of heavy oil.

It has been found in field applications that mineral salts, silica, clay inter alia that remain in the dehydrated crude promote corrosion cracking in stainless steel components and induce scale accretion and/or fouling of surfaces critical to efficient and consistent operation of the apparatus in the refiner and pipeline systems. Generally speaking, the salt crystals mix with the oil and coalescence results to form larger crystals which can pass through the refinery desalination equipment.

Accordingly, one object of the present invention is to provide advances to overcome the limitations encountered by the previous art.

SUMMARY OF THE INVENTION

One object of the present invention is to provide for a dry crude oil recycle stream around the dehydrator to mix with the feed to reduce the ratio of residual water to oil contacting the oil surface of the dehydrator and thereby allow for higher raw crude oil water cuts, while maintaining a stable dehydration operation.

A further object of one embodiment of the present invention is to provide a method of removing water and solids from crude oil containing water and solids, comprising:

a dehydration phase and a separation phase, the dehydration phase including:

providing a source of crude oil containing water;

providing a dehydrator for dehydrating the crude oil containing water, the dehydrator having an inlet and an outlet and a vaporizing surface of dry crude oil at temperatures sufficient to vaporize water contacting the surface;

exposing the source of crude oil to the dry crude;

vaporizing the water in the source;

the separation phase including:

isolating within the dehydrator solids present in dehydrated crude from the dehydrated crude; and re-circulating at least a portion of dehydrated and solid separated crude for contact with at least one of the dehydrator or the source of crude oil for maintaining a substantially uniform temperature at the vaporizing surface.

Conveniently, when at least a portion of the dry crude oil recycle stream around the dehydrator enters the dehydrator and is distributed below the surface of the hot crude oil in the dehydrator a consistent temperature is maintained at or above the vaporization temperature of water and at or below the surface of the oil and throughout the contained oil, thereby providing a means to mitigate the risk of process upsets and instability due to foaming.

A further object of the present invention is to provide a dry crude recycle stream around the dehydrator to mix with the feed stream, to allow an input of supplemental heat energy (external or waste heat energy) or recovery of heat energy from the dehydrator to result in an energetically efficient and balanced process.

A still further object of one embodiment of the present invention is to provide a method of removing water and solids from a crude oil containing water and solids, comprising:

a dehydration phase and a separation phase, the dehydration phase including:

providing a source of crude oil containing water;

providing a dehydrator for dehydrating the crude oil, the dehydrator having an inlet and an outlet and a vaporizing surface of dry crude oil at a temperature sufficient to vaporize water contacting the surface;

contacting the source and the dry crude oil to flash water from the source to thereby remove the water from the source;

the separation phase including:

isolating within the dehydrator solids present in dehydrated crude from the dehydrated crude;

re-circulating the dehydrated crude oil for contact immediately below the vaporizing surface; and re-circulating the dehydrated crude oil for mixing with the source of crude oil, whereby the vaporizing surface is selectively heated to return heat energy lost from flash evaporating water from the source.

The dry crude oil surface may be selectively heated by reintroduction of dry crude oil, auxiliary heat addition, etc. The important aspect is that the heat used for vaporization is replaced so that a uniform or substantially uniform surface temperature is maintained. This is one important unit operation to maintain.

A further object of the present invention is to provide a means to remove suspended solids accumulated in the contained dry crude oil introduced with the source oil and produced during dehydration.

Suspended solids in the dry crude oil recycle stream, may be removed by a separator means on a continuous or batch basis to avoid buildup, plugging, and other complications.

A further object of the present invention is to water wash the raw crude oil source combined with the treatment in the dehydrator to remove the soluble dissolved solids or contaminants introduced by the source crude oil and generate a low conductivity produced water and clean dry crude oil.

Until the advent of the present invention, prior art methods related to heavy oil dehydration had been limited by the stability of operation and risk of foaming, level of water cut or emulsion level in the heavy oil feed and the level of chloride, clay and silica compounds in the dry sales crude oil.

A still further object of one embodiment of the present invention is to provide a method of upgrading effluent containing crude oil to dehydrated crude oil, comprising:

a conditioning phase, a dehydration phase, and a separation phase, the conditioning phase including:

providing a source of effluent at least containing crude oil with water entrained therein and solids;

pretreating the effluent to remove at least some of the water and solids to thereby concentrate the crude oil;

the dehydration phase including:

providing a dehydrator for dehydrating the crude oil, the dehydrator having an inlet and an outlet and a vaporizing surface of dry crude oil at temperatures sufficient to vaporize water contacting the surface;

exposing the crude oil to the dry crude;

vaporizing the water in the crude oil to dehydrate the crude oil; and the separation phase including:

isolating within the dehydrator solids present in dehydrated crude to form clean dehydrated crude oil.

Enhancements have been developed to eliminate the limits imposed by water cut of the source crude oil feed and to provide a very clean and dry heavy oil product relatively free of water, solids and chlorides.

The present invention relates to process enhancements to an apparatus used for dehydrating crude oil containing water, comprising a casing, means for admitting and distributing the liquid crude oil into the casing and onto the host surface of the dry crude oil, means for controlling the level of crude oil and a means to transfer heat energy sufficient to maintain the liquid oil at or above the distillation temperature for evaporating water and light hydrocarbons.

A further embodiment of the present invention is to recycle and blend the condensed light hydrocarbon produced from the dehydrator, with the raw source crude oil, to provide a blend treating oil/water separation pretreatment step. The light hydrocarbons can optionally be combined with additional heavier diluent solvents to achieve both the volume and composition of diluent required to treat the emulsions. The diluent acts as a solvent for the oil, reducing the viscosity and density of the heavy crude oil and creates the density difference to separate the heavy oil from the produced water. The separation step can be performed at the temperature and pressure conditions of the raw well effluent or source oil. The heavy portion of the diluent will pass through the dehydrator and be retained in the sales oil of shipping diluent.

The light hydrocarbons and water exiting the casing are condensed by any suitable means known in the art, and collected and separated into water and light hydrocarbon liquid phases. Any non-condensible vapors are released from the apparatus for disposition by any safe means. Dry crude oil meeting pipeline BS & W specifications is pumped from the dehydrator for transport to refining and upgrading operations.

Typically, the dehydrator taught in the current art performed well to produce dry crude oil, however several problems have been encountered:

1. The dehydrator was limited to crude oil feed water cuts (wc) of less than 10% water to oil, and more specifically less than 5% wc to reduce the risk of unstable operation with foaming tendencies. This required the need for a conventional treater means upstream of the dehydrator to reduce raw crude oil water cuts from 50 to 20% wc down to less than 5% wc prior to feeding the dehydrator.

2. The dry crude oil exiting the dehydrator contains high chloride content, causing metallurgy and corrosion problems with downstream refineries facilities and transportation pipelines.

3. It was found that by flash evaporating off the water and by effectively eliminating all emulsions, solids such as clays and silica compounds, concentrated in the dry oil phase, had a tendency to buildup, plug and/or cause heat element damage.

4. It has been further experienced that the dehydrator is susceptible to unstable operations and foaming tendencies causing dehydration temperature swings and wet oil production.

The present invention seeks to address these concerns by providing methodology and apparatus to exceed the performance of the dehydrator beyond the prior art.

In one embodiment of the invention, at least a portion of the dry crude oil exiting the dehydrator is recycled and mixed with the inlet crude oil feed prior to entering the dehydrator casing. By increasing recycle flow, a consistent and stable inlet water cut composition can be maintained at the entrance to the casing to control the tendency to foam and create operational complications. With greater recycle rates, the raw water cut levels can be increased above the 10% wc stable level and continuous stable operation is maintained. This eliminates the need for conventional treatment ahead of the dehydrator and can avoid dehydrator process upset if an upstream treater is used and a treater upset occurs.

A further embodiment of the invention requires that at least a portion of the recycled dry crude oil be recycled and distributed immediately below the dry crude oil evaporating surface. This method ensures that the temperature of the surface of the dry oil in the dehydrator is maintained at or above the flash evaporating temperature of water. Water droplets from the feed are not permitted to penetrate the surface of the crude oil, thereby preventing the cooling below the surface and creating surface breakdown foaming and unstable dehydrator operation.

Advantageously, external heat transfer means can be added to the recycle circuit supra to regulate the precise temperature of the feed stream to the dehydrator casing. This method enhancement will regulate the precise level of pre-flashing of water vapour in the feed oil to control the residual water level contacting the hot dry oil surface. This step can be used to prevent the overcooling of the bath and eliminate the foaming effects caused by excessive evaporation surface breakdown.

As a further feature, a solid/liquid separation device, examples of which include a filter, hydro cyclone, centrifugal separators, gravity separators, centrifuge or any combination thereof, etc., may be employed in the circuit of the recycle stream continuously or on a batch basis to remove suspended solids from the hot dry oil.

Additionally, a clean water washing circuit may be added to the dehydrator feed to reduce undesirable dissolved compounds, such as chlorides, from the dry crude oil. The entire contaminated water stream, or a portion thereof, is treated by a suitable treatment method to create a clean water stream and a highly concentrated brine, slurry or solid product. The recovered clean water is recycled back to the raw crude oil for oil pretreatment. Generally water or any aqueous solution containing compounds for enhancing the extraction of chloride is most desirable, otherwise any regenerable fluid with a suitable aggressive solubility for chlorides may be considered.

It is preferable that in addition to achieving a dehydrated oil, having a BS&W content of less than 0.5% wc by volume, the embodiments of the invention in combination, or separately applied, can produce a dry clean crude oil, substantially free of solids, containing less than 30 ppm (wt) chlorides, in a continuous and stable operation, with low risk of foaming and process upsets. The oil produced by the present process is readily vendible and is most desirable, particularly in the case of heavy crude oils with gravities in the 7° API to 20° API range.

Having thus described the invention, reference will now be made to the accompanying drawings illustrating preferred embodiments.

BRIEF DESCRIPTION OF THE DRAWINGS

Similar numerals employed in the Figures denote similar elements.

DETAILED DESCRIPTION OF THE PREFERRED EMBODIMENTS

Figure 1:
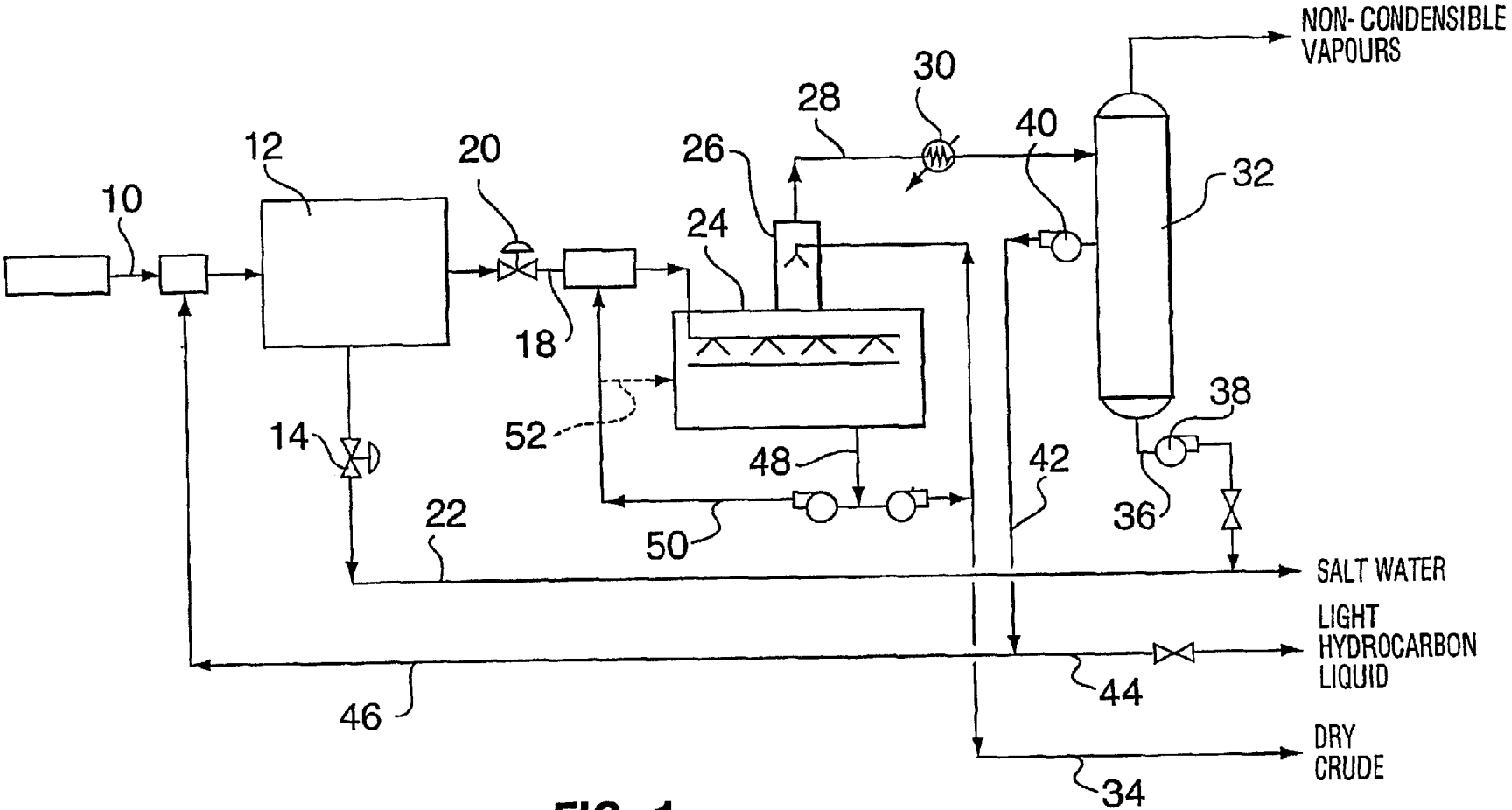
FIG. 1 is a schematic flow diagram which illustrates the dry oil recycle to the dehydrator feed stream and dehydrator.

With reference to FIG. 1, heavy oil with a viscosity of between 7° API and 20° API denoted by numeral 10, typically includes a mixture of crude oil, water, oil/water emulsion, dissolved compounds such as chlorides and solid particles such as clay, metals and silicas. The crude oil is generally received in a gravity separator, heated or non heated treater 12, under pressure from between atmospheric pressure to 100 psig. Heated treaters typically operate from 170° F. to 285° F. (77° C. to 141° C.). In the treaters, solid particles and bulk brackish water is separated and removed from the raw crude oil at 14. Water cuts of less than 10%, to more typically 5% by volume can be achieved in the raw crude feed 18 exiting the primary treatment through a valve member 20. The water stream 22 generally contains dissolved compounds such as sodium chloride, (5,000 to 50,000 ppm (wt)) and silica, and suspended compounds such as clay and sand.

The raw crude oil at approximately 5% water cut in the emulsion form, containing no free water, enters the dehydrator 24 where the crude oil and emulsions are evenly distributed onto the hot surface of dry crude oil (not shown), operating at or above the evaporation temperatures of the water. Water is flashed off the oil or separated by distillation, with water and low boiling temperature hydrocarbon components from the oil exiting through the column 26 and passing through line 28. If desired, the water and lower boiling components may be sent to a condenser 30 and subsequently to a vapor liquid separator 32. Dehydrated higher boiling point crude oil is discharged from the dehydrator 24 through line 34.

In the separator 32, water and light hydrocarbons are separated by differences in specific gravity. The water is discharged through line 36 and pump 38. The light hydrocarbons are transferred from the separator 32 using pump 40 via line 42, and can be removed for disposal at line 44 or at least a portion recycled and mixed with the inlet crude oil 10 via line 46, to dilute the incoming crude oil and thereby facilitate its further treatment. Non condensible, i.e. light hydrocarbons, inert gases (nitrogen, carbon dioxides, hydrogen sulfide) are vented from separator 32 and disposed of or recovered by any suitable safe means.

As shown by FIG. 1, dry oil can be recycled from 48 and recycled as stream 50 to mix with the inlet feed 18, prior to being distributed onto the hot oil surface in the dehydrator 24.

In order to maintain the temperature of the hot oil surface, at least a portion of the recycle stream 50 can be recycled directly to the dehydrator 24 and be distributed at or immediately below the surface of the hot dry crude oil. It has been found that by recycling the dry crude oil to inlet stream 18, and separately or in combination with recycling dry crude oil to the surface of the hot bath by using stream 52 (dashed lines), the following significant benefits can be realized:

a) The water cut of the raw crude oil at stream 18 can be increased to greater than 10%, and even greater than 20% by volume. This enhancement means that the requirement for conventional treatment denoted as 12 can be eliminated, without risk of process instability and foaming of the dehydrator.

b) If a conventional primary treatment 12 is used, the recycle stream can be used to isolate the dehydrator from unstable or operational complications if the pretreatment becomes unstable. This means that the dry crude oil sales specification is not at risk, and rerun of off spec sales oil from sales oil storage tanks and pipelines is avoided.

The ratio of recycle at 50 to inlet feed can vary depending on the actual temperature and rate of the recycle 52 and the level of feed conditioning and water cut reduction required at the inlet to the dehydrator. Similarly, the ratio of recycle 52 to recycle 50 will vary for each application in order to establish a balance between dehydrator feed conditioning and dehydrator surface temperature. Depending on the relative size of oil recycle 50 to dry sales oil 34, common pumps or separate pumps may be used, as known to those skilled in the art. Recycle 52 can also be provided by separate pumping means.

Figure 2:
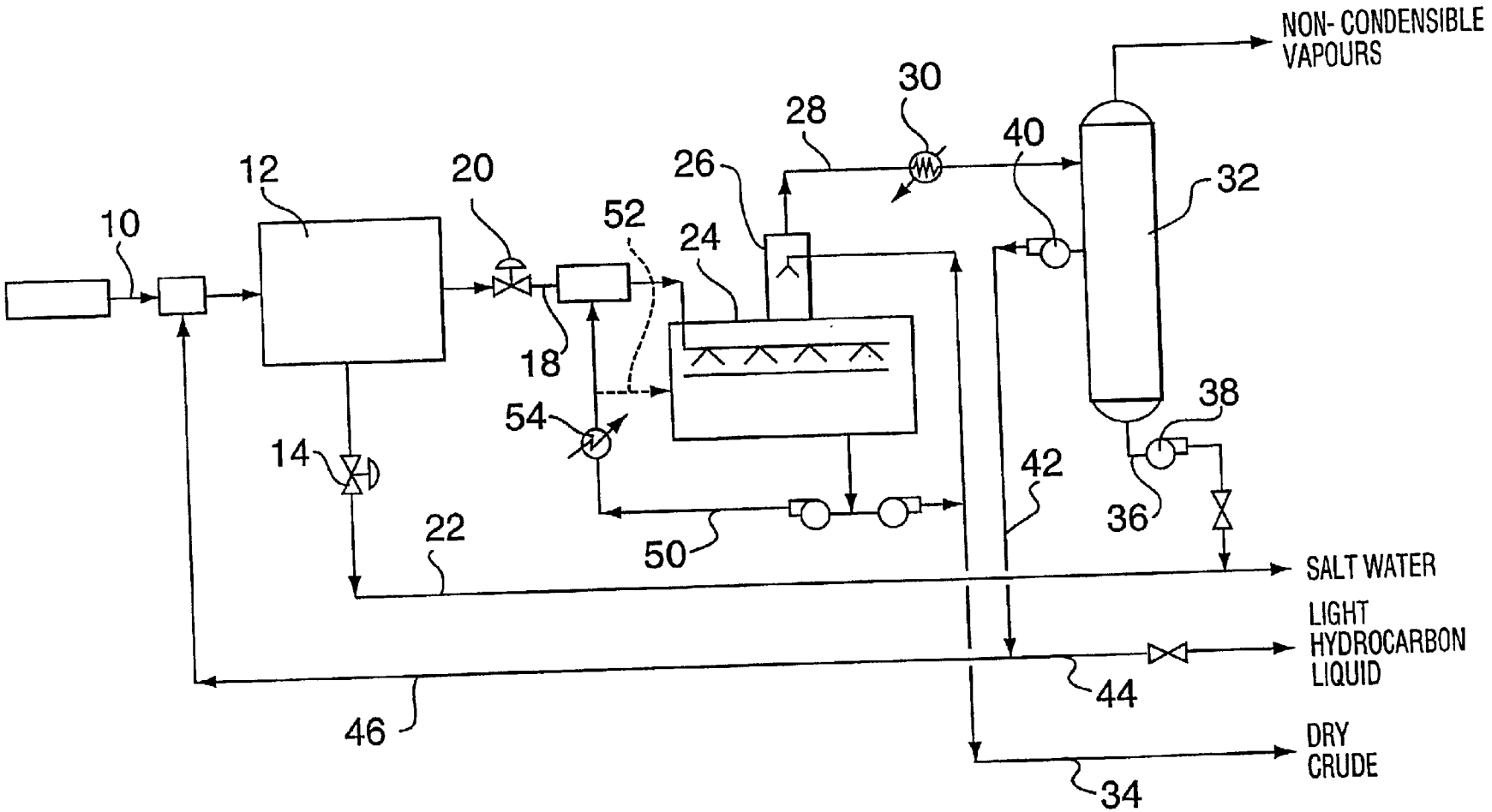
FIG. 2 is an additional schematic flow diagram showing external heat exchange on the recycle for temperature adjustment of the feed or surface of the dehydrator or both.

Referring to FIG. 2, shown is an enhancement to the recycle variation of FIG. 1, where a heat exchanger means 54 is added to the recycle circuit to condition the temperature for steams 56 and 52. The streams, 56 and 52 can be heated or cooled to the same temperature or independently to separate temperatures in order to seek the thermal balance of the feed stream and hot crude oil bath surface. Any form of suitable heat source, such as direct fired heaters, indirect fired heaters, heat exchangers or heat recovery or cooling apparatus may be selected. A further consideration for temperature at the streams 56 and 52 is whether the feed is from a heated primary treatment means at 170° F. to 285° F. (77° C. to 141° C.) or from a raw crude storage tank at 60° F. to 100° F. (16° C. to 38° C.).

Figure 3:
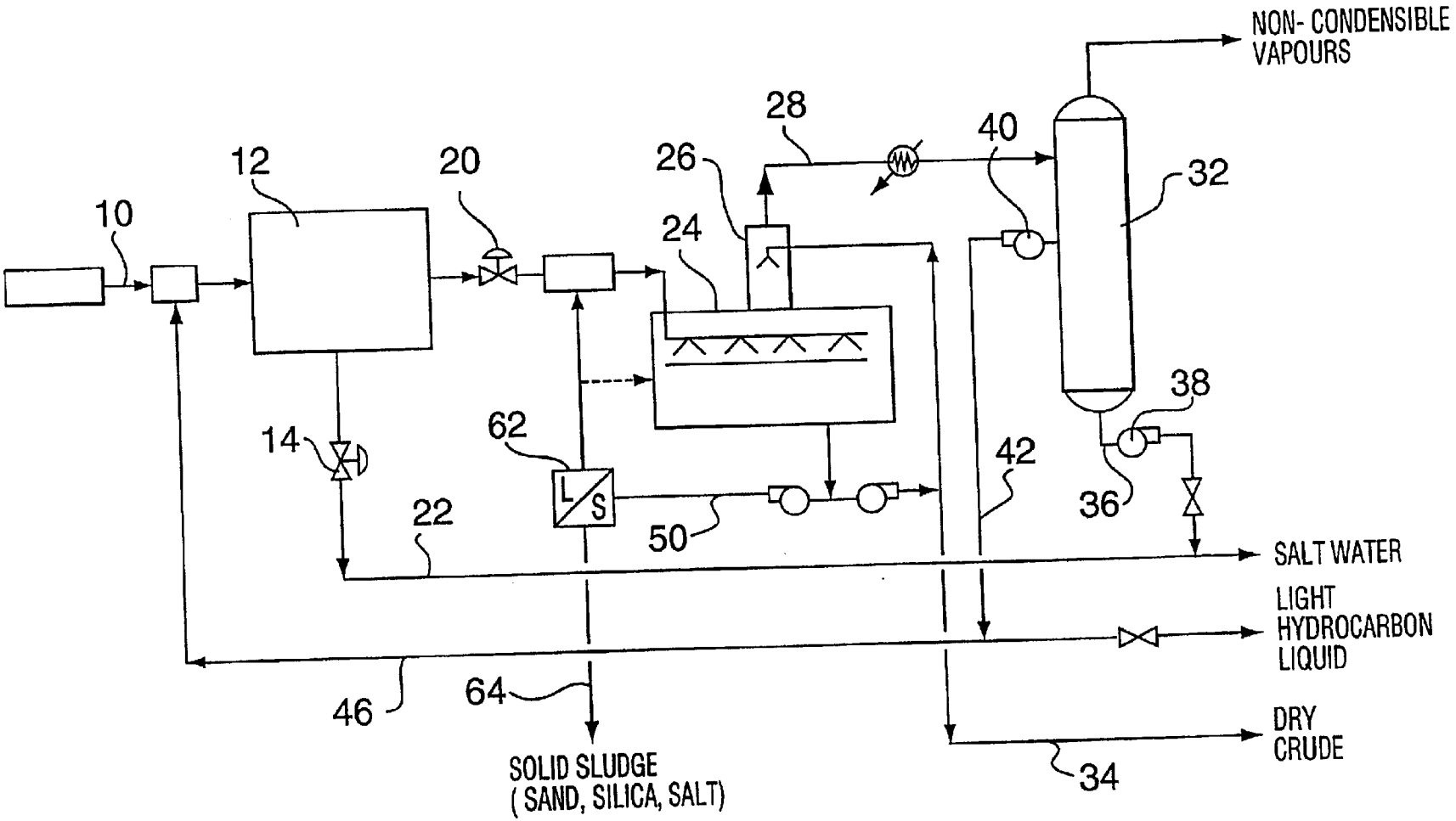
FIG. 3 is a further schematic flow diagram showing a solid/liquid separator for removal of suspended solids.

FIG. 3 illustrates an additional enhancement to include a solid/liquid separator means 62, used to remove suspended solids such as clay, sand, and precipitated salts from the dehydrated crude oil. The solid/liquid separator 62 may be selected from any suitable separator device known to those skilled in the art, such as gravity separators, clarifiers, filter, screens, cyclones and centrifuges. The recycle stream from 50, is sized to satisfy the range of operation of the solid/liquid separator device 62 and specifically sized to accommodate a solids removal rate at 64 greater or equal to the solids content entering the dehydrator 24 at 18 and being produced in the dehydration process.

The removal of the solids can be performed on a continuous or batch basis and primarily allow for the ongoing removal of solids from the dehydrator 24 to prevent buildup and plugging. Buildup of solids on the heating elements contained in 24 or external to 24 is detrimental to the elements performance and can become a safety issue.

Figure 4:
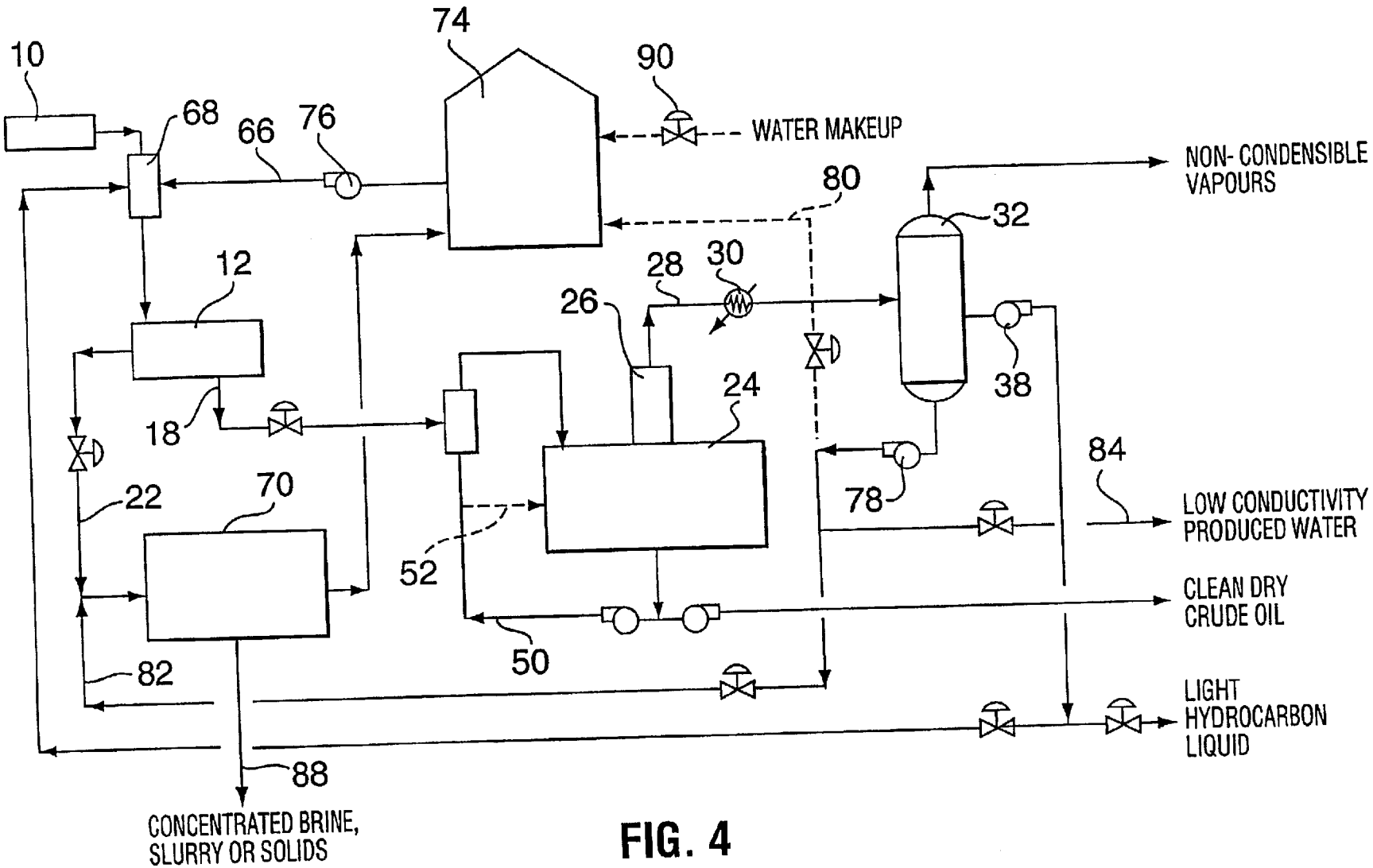
FIG. 4 is a schematic flow diagram illustrating the addition of water washing for removal of dissolved compounds such as chlorides.

Turning to FIG. 4, shown is a further variation of the invention showing the addition of a water wash means to the dehydrator to remove dissolved solids. The raw crude oil can contain high concentrations of sodium, calcium, magnesium, chlorides, sulfur, carbonates, silica, etc. All these compounds, especially the chloride are currently undesirable in the dry crude sales product and may have significant commercial impact on the price for the crude oil, or even restrict sales. Typically, refineries are currently requiring less than 30 ppm(wt) chlorides in the sales crude oil.

Using the enhancement shown by FIG. 4, clean water 66 is injected and intimately mixed with the raw crude oil 10 at 68. The feed mixture 10 is passed through primary treatment separator at 12. The bulk of the brine contaminated water is separated from the oil and discharged through line 22 to a water treatment unit 70.

The washed crude oil is discharged at 18 and becomes the feed stream to the dehydrator. The feed can be conditioned either in the primary treatment 12 or by using the recycle stream 50 and 52 to ensure stable dehydrator 24 operation. The washed crude at 18 contains significantly reduced levels of dissolved compounds, meeting or exceeding the sales oil specification requirements.

The water treatment scheme selected for each application must ensure that the undesirable compounds in stream 22 are sufficiently removed to satisfy the process removal requirements at 18. Typical water treatment practices, are microfiltration, reverse osmosis, distillation, flocculation, clarification and coagulation.

Treated water 72 enters the treated water surge vessel 74 and is transferred by pump 76 for reinjection at 68 using line 66.

As an option, condensed water from the separator 32 can be transferred directly by pump 78 to either the treated water surge tank 74 by line 80 or to a water treatment unit 70 by line 82 if water treatment is required. The net water production would discharge from the separator 32 at stream 84, or from the water treatment unit 70 by means of stream 88. Fresh water makeup can be introduced to the treated water storage tank 74 at 90 if a water balance deficit is encountered.

Figure 5:
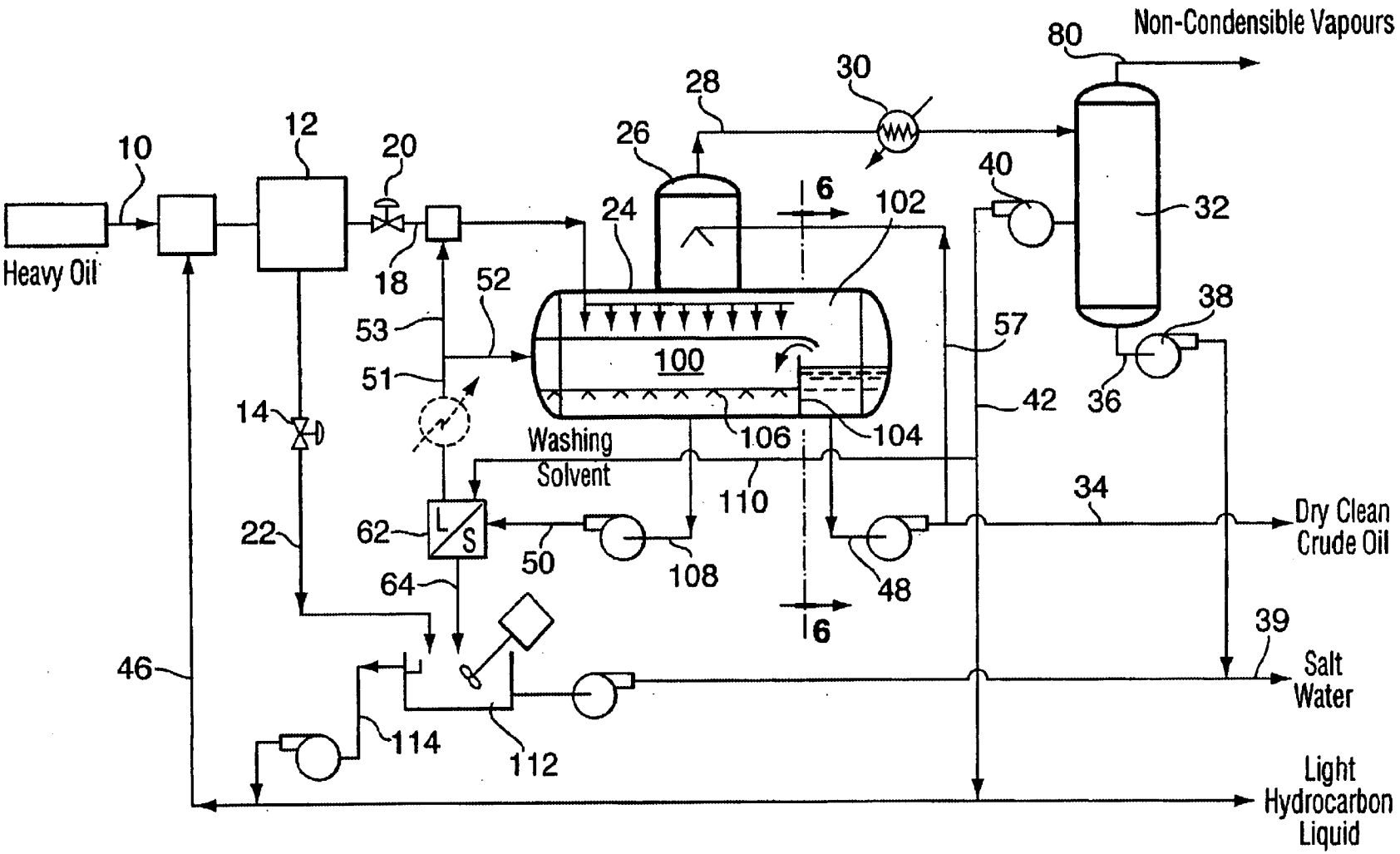
FIG. 5 is a schematic flow diagram illustrating a further embodiment of the present invention.

Referring now to FIG. 5, shown is a further embodiment of the present invention where the dehydrator 24 is divided into zones for solids separation. As is illustrated in FIG. 5, there is a solid separation zone, generally denoted by numeral 100 within the dehydrator 24 and a clean, dry oil zone denoted by numeral 102. Zones 100 and 102 are separated by a separation baffle 104, which baffle 104 may be composed of any suitable baffle structure known to those skilled in the art for isolation of a liquid containing suspended solids such that the baffle facilitates sufficient residence time to permit gravity settlement of the existing solid or solids which are in a growth phase. The baffle 104 therefore provides a weir where hot/dry oil may flow into zone 102 substantially free of any solids.

Figure 6:
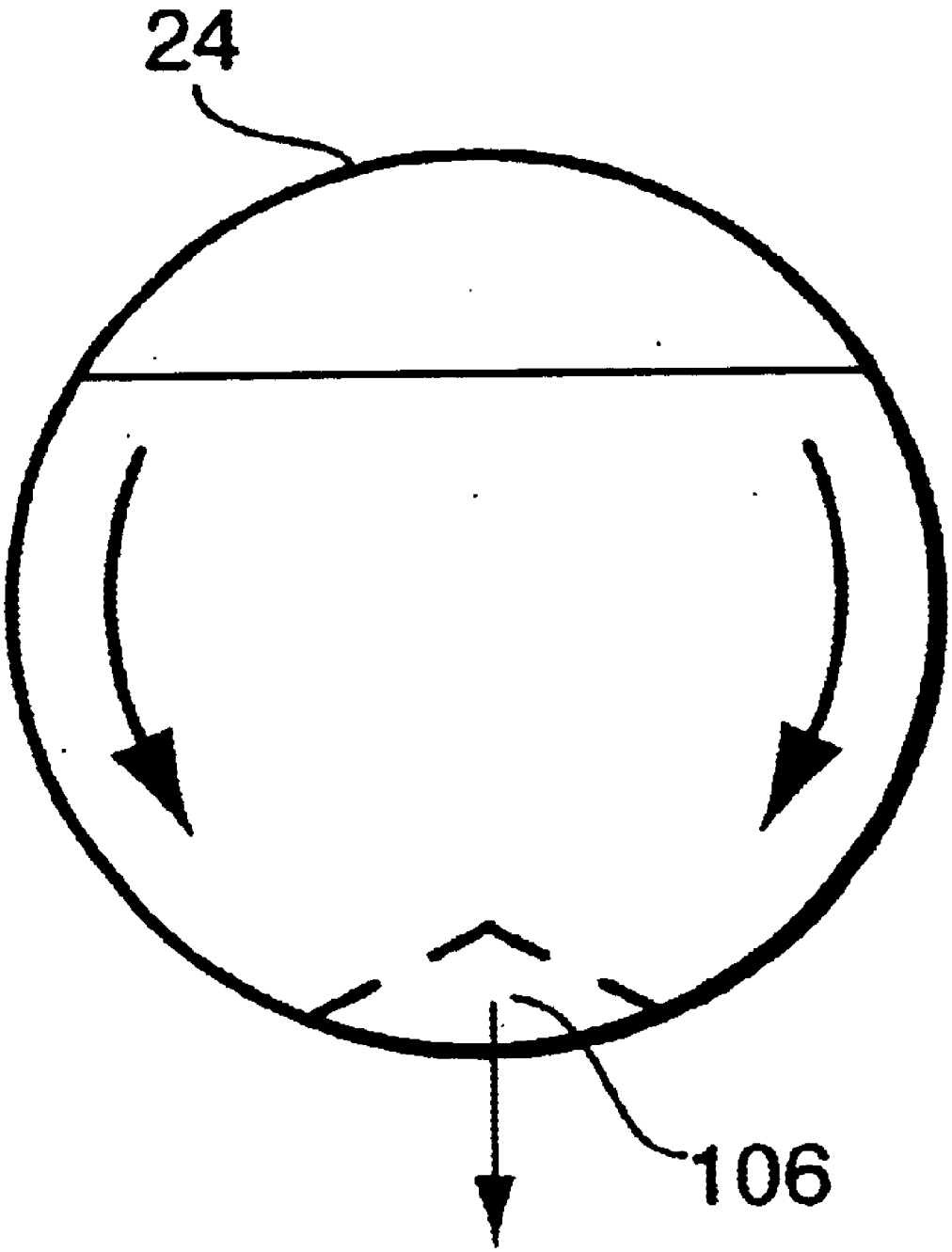
FIG. 6 is a section along line 6—6 of FIG. 5.

The solid (not shown) may be collected in a pan structure denoted by numeral 106 and shown best in FIG. 6.

The dry oil recirculation loop, denoted by numeral 108 containing suspended solids from between 0 weight percent and 30 weight percent and more particularly, near 0 (0.5 weight percent) to 5 weight percent are pumped through line 50 to a solids/liquid separation means 62. The solids may be removed by simple purge stream (either batch or continuous) or by a solid/liquid separation device such as a gravity settling tank or vessel, filter device, filter press, hydrocyclone, centrifugal separator or centrifuge or any combination of these components (none of which is shown). A flushing recycle loop (not shown) is commonly included between line 50 and pans 106 to assist with flushing of the solids and prevents solids build up. A washing solvent, such as a portion of the diluent created by the flash treating process, denoted by numeral 110 may be used to wash the solids free of any hydrocarbon compounds.

The hot dehydrated oil, now substantially free of suspended solids is recycled from separation device 62 to the dehydrator bath surface 52 (just beneath the surface as shown in the drawing) and/or the source oil inlet, denoted in this Figure by numeral 53. The hot dry oil surface circulates internally along the dehydrator and accumulates into the dehydrated oil zone 102 for further transfer by a line 34. Further heat energy may be added to the recycle stream 51 to maintain a level of vaporization in the source oil inlet and the desired temperature of the hot dry oil surface. Where the temperature of the source oil at 18 is sufficiently high to meet the energy balance of the dehydrator for a given source oil water content, then stream 53 may be deleted entirely. Heat energy may be added in the recycle streams and/or internally of the bath of the dehydrator 24 as discussed herein previously. Common practices of internal heating, well known to those skilled, consist of fire tubes or other heating devices (not shown).

The solids, sludge and other wash diluent as well as hydrocarbon carryover from 30 separation device 62 may be disposed of directly or redissolved/slurried into the source water with a mixing device, globally denoted by numeral 112. Diluent and hydrocarbon fluids can be skimmed from tank 112 through circuit 114 and recycled via line 46 to the source 10.

The recycle rate for a circuit 50 may be set by the process heating requirements of the streams 52 and 53 or the minimum rate required by the solid liquid separation device 62 to remove the level of source suspended and produce solids on a continuous or batch processing basis. The recycle streams may also be separate with different pumping devices to meet specific needs. The size of the solids and particle distribution of the solids will vary depending on the solid composition, the level of solid residence time and the final solids concentration designed into the dehydrator and the methodology selected for removal.

Figure 7:
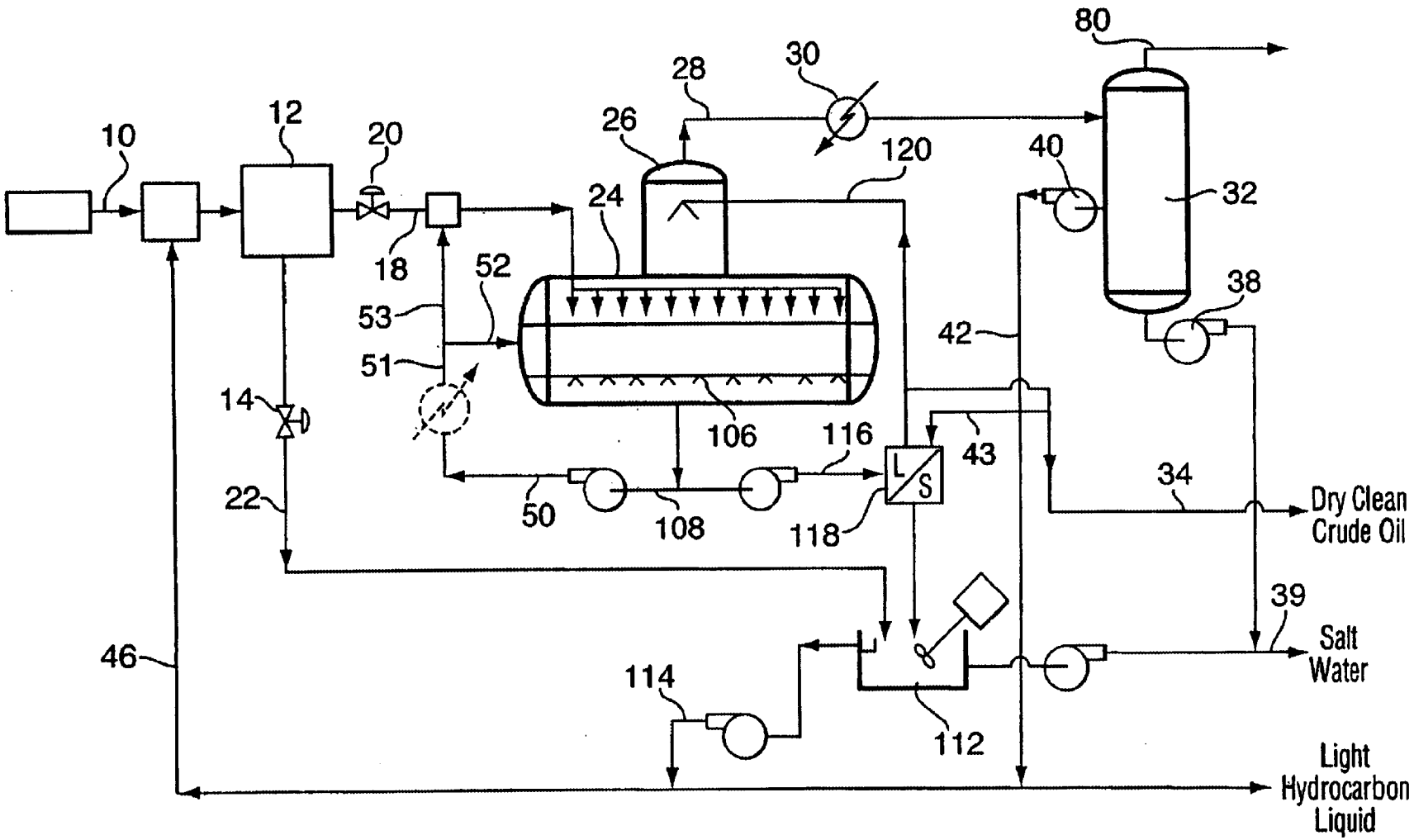
FIG. 7 is a schematic flow diagram illustrating a further embodiment of the present invention.

Referring now to FIG. 7, shown is a further variation of the arrangement shown in FIG. 5. In this embodiment, the baffle 104 is absent the internal volume of the dehydrator 24. In this configuration, solids collect in the entire bottom of the dehydrator 24 and collect at the pans 106 illustrated in FIG. 7 and in cross section in FIG. 6. Recycle stream 50 supplies necessary thermal energy as discussed herein previously and may also be employed for flushing pans 106.

A separate stream 116 can be drawn from the bottom of dehydrator 24 and passed through a solid liquid separation device 118. Dry crude, substantially free of solids can then be transferred from the separation device 118 via line 34. Any surplus dry oil can be recycled to provide a defoaming function to flash gases (not shown), the surplus oil indicated from separation device 118 via line 120.

Figure 8:
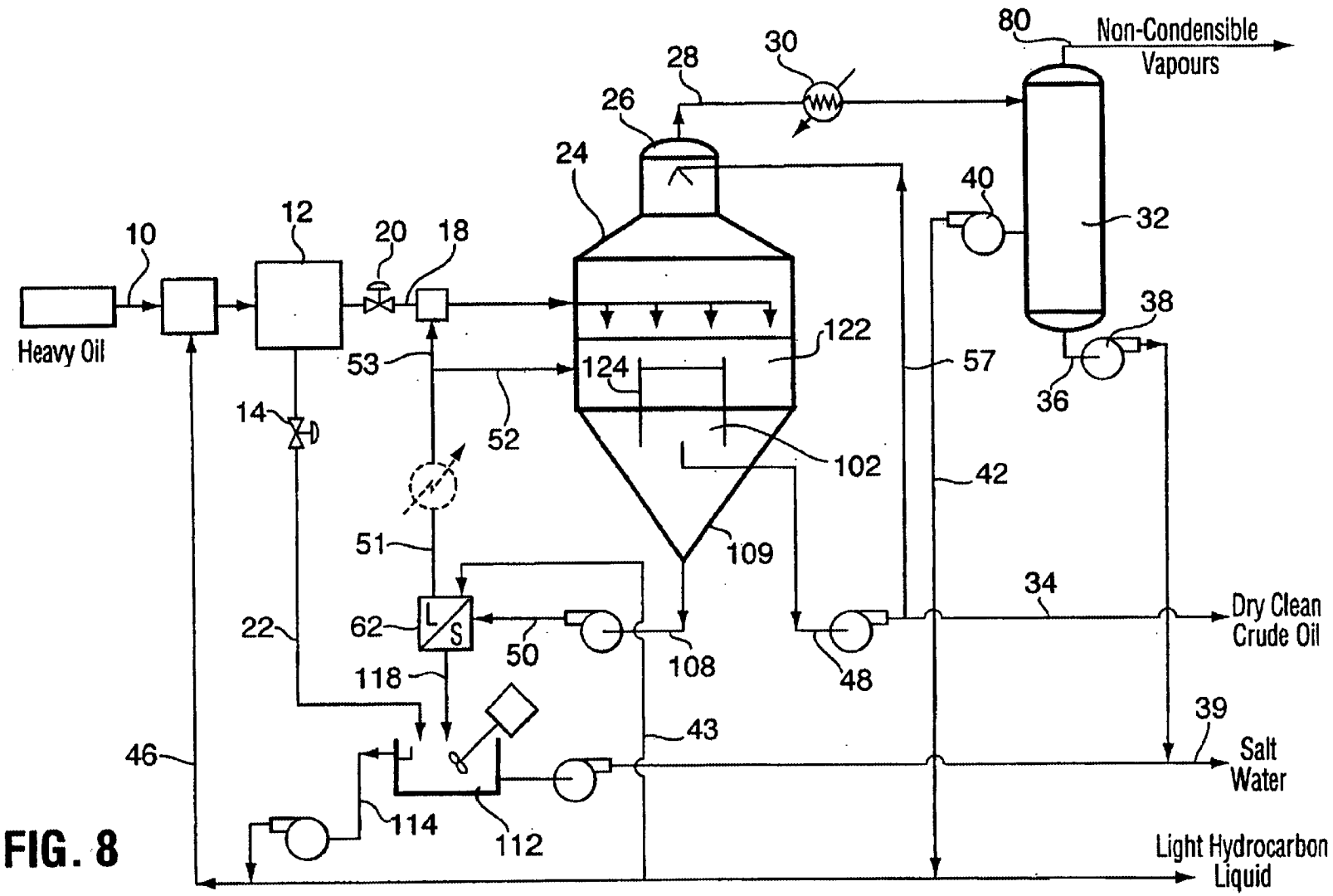
FIG. 8 is a schematic flow diagram illustrating yet another embodiment of the present invention.

With respect to FIG. 8, the treater 24, in this embodiment, is reconfigured from the longitudinally disposed arrangement shown in the previous Figures to a conical version as illustrated in FIG. 8. This arrangement is useful for higher solids loading in the material to be treated, to accommodate space restriction or alternate distillation configurations.

In the example, the dehydrator 24 is reconfigured to a vertically disposed cylindrical design with a conical bottom section. An advantage associated with this arrangement has been the possibility of introducing the recycle oil and or source oil via a centrifugal entry. This has energy ramifications since it is known that mechanical agitation, particularly by a centrifuge, will result in solid particles being disassociated from the liquid within which they are contained. At the same time gravity settling is achieved in the bottom conical section of the dehydrator. By combining the two separation techniques, i.e. the mechanical agitation and the gravity separation, a dry clean oil zone develops approximately in the middle region of the dehydrator, broadly denoted by numeral 122 and solids are prevented from entering this zone due to the motion of the fluid and the introduction of a coaxial baffle 124. Dry oil, substantially devoid of any solids is removed via line 48 and transferred for subsequent unit operations or sales or further recycled back to dehydrator 24 for any other suitable purpose (defoaming, temperature control, etc.). Dry oil with solids entrained therein is transferred to separation device 62 as indicated herein previously where a substantial amount of the solids are removed by simply purging or by suitable separation as discussed herein previously.

Figure 9:
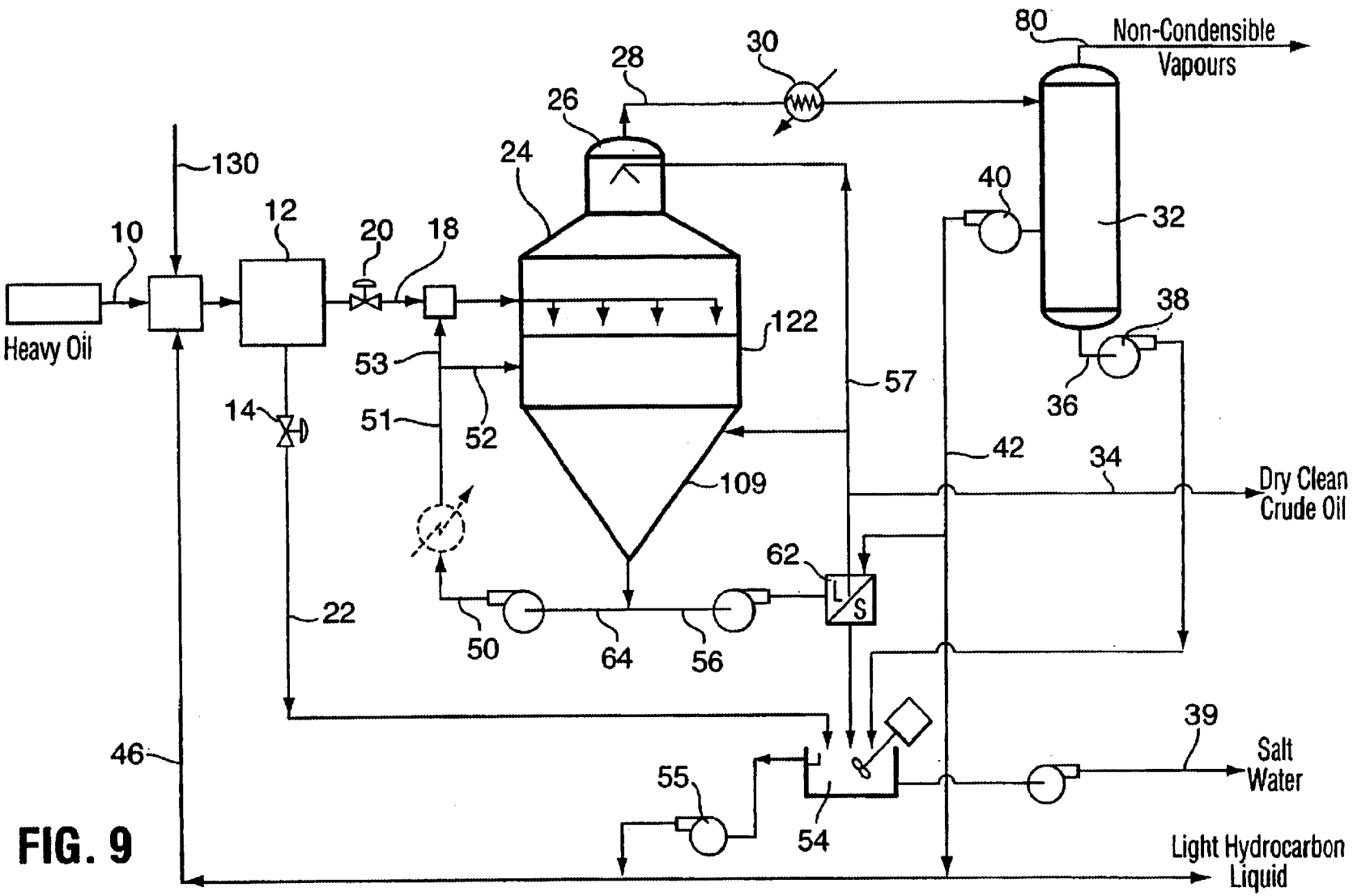
FIG. 9 is a schematic flow diagram illustrating a further embodiment of the present invention.

Turning to FIG. 9, shown is a further variation on the conical dehydrator system. In this embodiment, dry oil with solids entrained therein is collected entirely within the conical section denoted by numeral 109 of dehydrator 24. Once within the conical section 109, the fluid is circulated to provide the necessary energy requirement at loops 52 and 53 as discussed herein previously.

Figure 10:
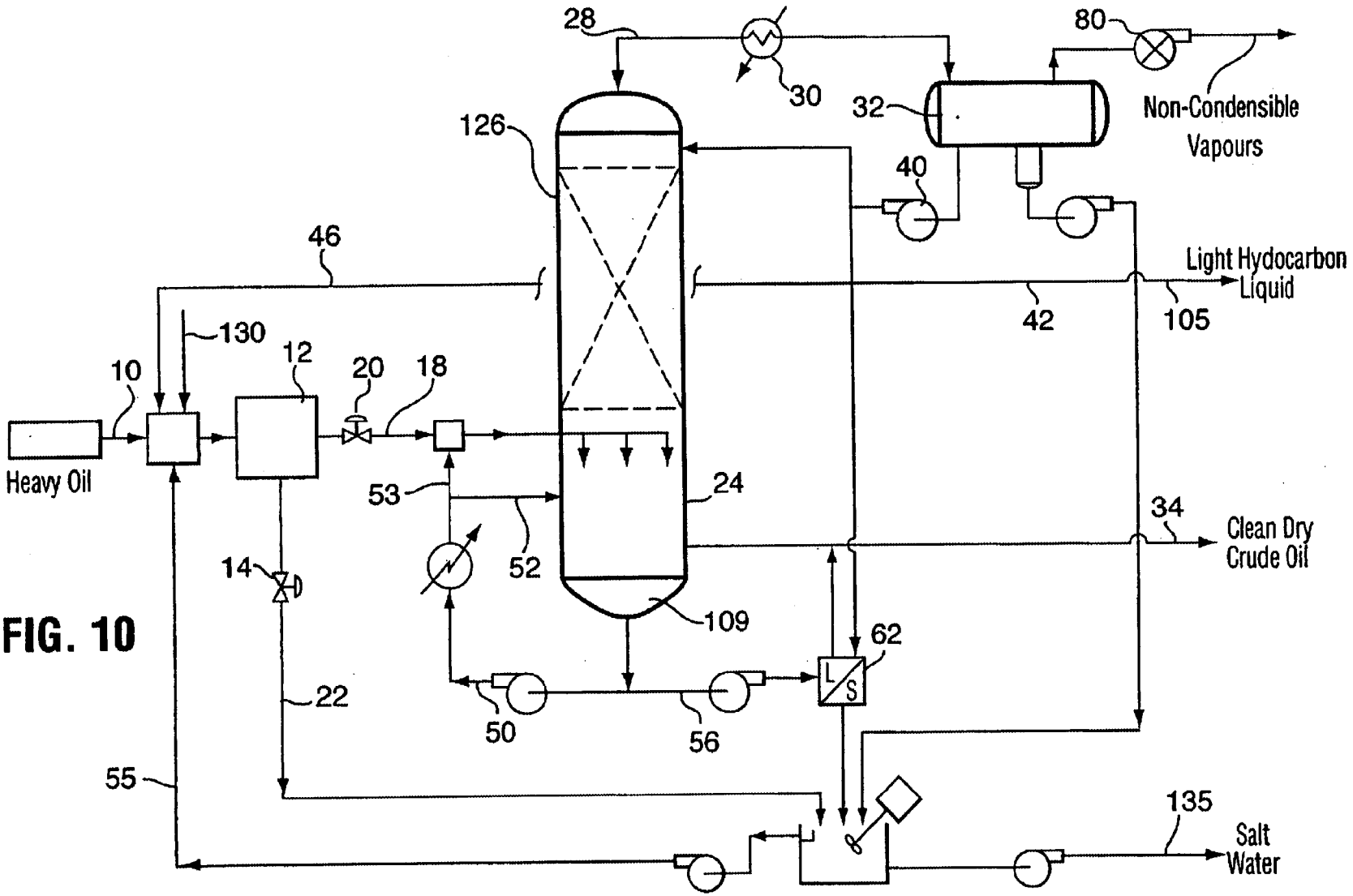
FIG. 10 is a schematic flow diagram illustrating another embodiment of the present invention.

In FIG. 10, further modifications to the dehydrator 24 are illustrated in the process flow diagram depicted. In this embodiment, a distillation tower extends from the dehydrator 24, with the distillation tower being broadly denoted by numeral 126. This is a particularly convenient feature since the distillation portion 126 can be employed to selectively separate and distill any hydrocarbon fraction desired.

Operational parameters for the distillation tower 126 will be appreciated by those skilled in the art. The distillation apparatus may be attached directly to the unit or provided separately.

Figure 11:
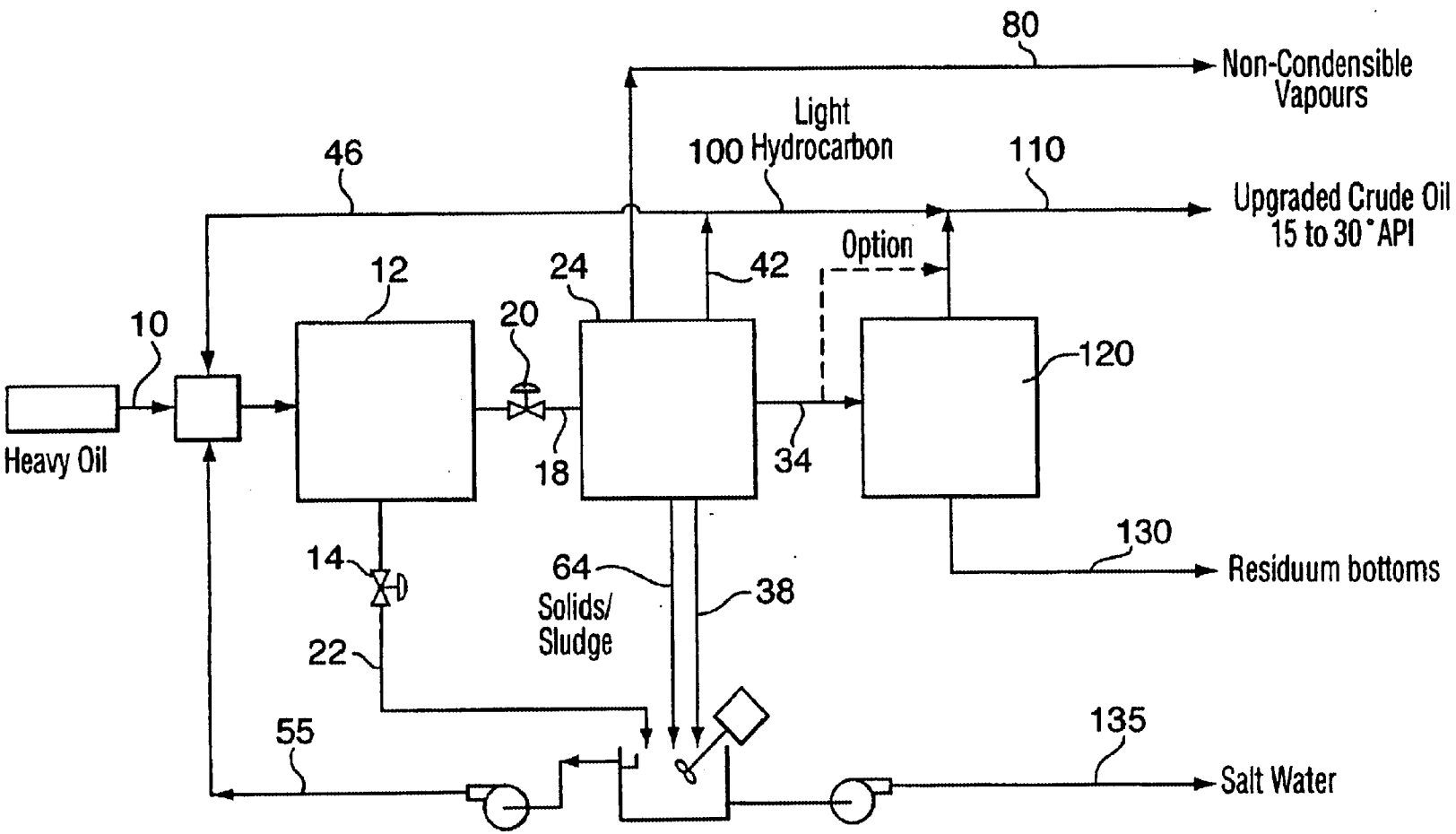
FIG. 11 is a schematic flow diagram illustrating a still further embodiment of the present invention.
Figure 5:
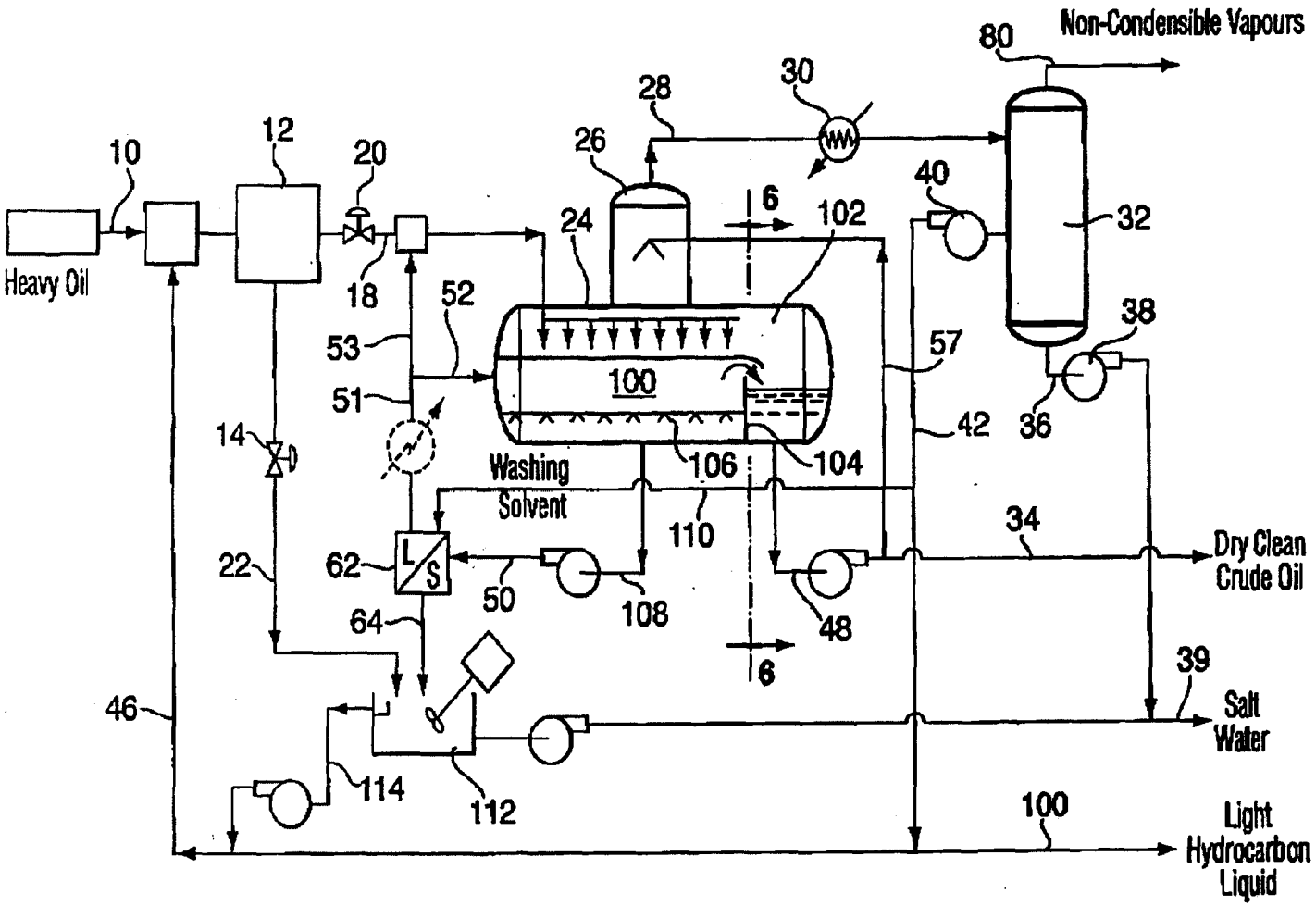

Turning to FIG. 11, shown is a dehydration, separation and upgrading process flow diagram where the dehydration circuit shown herein previously is joined with an overall processing scheme for upstream heavy oil production such as SAGD or CSS.

In this embodiment, the source is well effluent, sharing a common numeral with the source from previous flow diagrams. The effluent 10, which is typically at a temperature of greater than 285° F. and at approximately 350 psig (140° C. and 2400 kPa) is introduced for pretreatment at 12 where bulk water, solids, dissolved compounds, inter alia are removed. The hot emulsion, generally containing less than 5 weight percent BS and W is flashed in dehydrator 24 at atmospheric pressure and temperatures of greater than 220° F. (105° C.) where the water and light hydrocarbons are distilled and suspended solid contaminants are removed. The dry heavy oil exiting the system at 34 is a particularly useful stream for heavy oil partial upgrading processes (such as distillation, vacuum distillation and solvent deasphalting) where the crude oil product quality is upgraded from approximately 7 to 10 API to about 21 API with a viscosity of less than 350 cSt at 10° C., primarily for pipeline transport to refineries.

As an alternative, the cleansed dry heavy oil is also suitable as a precursor material for full upgrading conversion such as visbreaking, hydroprocessing, and thermal cracking. In the absence of the upgrading process, the cleansed dry crude requires blending with about 20% to 30% by volume diluent and subsequently must be shipped as dilute crude product by pipeline to a refinery capable of treating the blended heavy oil.

By following the enhancements independently or in combination, the process methods as described by this invention, will result with dry clean crude oil meeting or exceeding new sales specifications for commercial sale.

As a further variation, FIGS. 9 and 10 illustrate an optional diluent makeup stream 130 which can be mixed with the light hydrocarbon stream 46 and blended with the source crude oil 10 prior to the pretreatment step 12. The addition of the diluent reduces the density and viscosity of the heavy oil and creates the density difference and separation motive force between the heavy oil and the produced water, thereby breaking down the oil emulsion and producing a lower water cut oil feed to the dehydrator at 18. A further advantage of this embodiment is that the pretreatment separation step can be performed at the source crude oil inlet pressures and temperatures, typically less than 140° C., thereby requiring no additional heat energy input. The diluent makeup stream can primarily contain heavier molecular weight components, such as pentane and heavier, and perform the separation function and generally pass through the dehydrator with the sales oil and form part of the shipping diluent volume required.

A further advantage of the blend treating pretreatment step is that only the low water cut dehydrator feed 18 is heated to above 100° C. for flash treating. The dehydrator operating temperature and pressure are selected, by those skilled in the art, to match the required diluent 130 and light hydrocarbon 46 volume and composition and perform the basic water distillation function. By carefully selecting the dehydrator distillation and hydrocarbon recycling conditions, a specific hydrocarbon distillation cut can be achieved for the sales oil, thus providing a controlled feed composition 34 for further downstream full or partial upgrading operations 120.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. A method of removing water and solids from a crude oil containing water and solids, comprising:

a dehydration phase and a separation phase, said dehydration phase including:

providing a source of crude oil containing water;

providing a dehydrator for dehydrating said crude oil, said dehydrator having an inlet and an outlet and a vaporizing surface of dry crude oil at a temperature sufficient to vaporize water contacting said surface;

contacting said source with said dry crude oil to flash water from said source to thereby remove said water from said source;

said separation phase including:

isolating within said dehydrator, solids present in dehydrated crude from said dehydrated crude;

re-circulating said dehydrated crude oil for contact immediately below said vaporizing surface; and re-circulating said dehydrated crude oil for mixing with said source of crude oil, whereby said vaporizing surface is selectively heated to return heat energy lost from flash evaporating water from said source.

2. The method as defined in claim 1, further including a step of collecting and condensing light hydrocarbon fluid evolved from flashing crude oil and re-circulating dehydrated crude oil.

3. The method as defined in claim 2, wherein collected and condensed light hydrocarbon fluid is collected and condensed with distillation means.

4. The method as defined in claim 3, further including the step of re-circulating condensed light hydrocarbon fluid to said source of crude oil.

5. The method as defined in claim 2, further including the step of diluting said source of crude oil with condensed light hydrocarbon fluid.

6. The method as defined in claim 1, wherein said light hydrocarbon fluid heating is provided by at least one of re-circulating dehydrated crude oil into said dry crude oil and re-circulating dry dehydrated crude oil into contact with said source of crude oil.

7. The method as defined in claim 1, wherein said solids are isolated by at least one of gravity separation and mechanical agitation within said dehydrator.

8. A method of upgrading effluent containing crude oil to dehydrated crude oil, comprising:

a conditioning phase, a dehydration phase, and a separation phase, said conditioning phase including:

providing a source of effluent at least containing crude oil with water entrained therein and solids;

pretreating said effluent to remove at least some of said water and solids to thereby concentrate the crude oil;

said dehydration phase including:

providing a dehydrator for dehydrating said crude oil, said dehydrator having an inlet and an outlet and a vaporizing surface of dry crude oil at temperatures sufficient to vaporize water contacting said surface;

exposing said crude oil to said dry crude;

vaporizing said water in said crude oil to dehydrate said crude oil; and said separation phase including:

isolating within said dehydrator, solids present in dehydrated crude to form clean dehydrated crude oil;

re-circulating said dehydrated crude oil for contact immediately below said vaporizing surface; and re-circulating at least a portion of dehydrated and solid separated crude for contact with at least one of said dehydrator or said source of crude oil for maintaining a substantially uniform temperature at said vaporizing surface.

9. The method as defined in claim 8, further including the step of upgrading said dehydrated crude oil from between 7 API and 10 API to 21 API.

10. The method as defined in claim 8, further including the step of upgrading said dehydrated crude oil by unit operations selected from the group consisting of visbreaking, hydro processing, thermal cracking and distillation.

11. The method as defined in claim 8, wherein said dehydrated crude has a viscosity of 350 Cst at 10 Celcius.

12. The method as defined in claim 8, further including the step of collecting gaseous components from vaporizing in said dehydrator with distillation means.

13. The method as defined in claim 12, further including the step of recycling condensed gaseous components for dilution of said effluent.

14. The method as defined in claim 8, further including the step of providing a diluent makeup stream for contact with said effluent prior to pretreating.

* * * * *

UNITED STATES PATENT AND TRADEMARK OFFICE

CERTIFICATE OF CORRECTION

PATENT NO. : 6,849,175 B2
DATED : February 1, 2005
INVENTOR(S) : Steve Kresnyak

It is certified that error appears in the above-identified patent and that said Letters Patent is hereby corrected as shown below:

Drawing sheet consisting of Fig. 5, should be deleted and replaced with the drawing sheet, consisting of Fig. 5, as shown on the attached page.

Column 7,
Line 12, "ture for steams 56 and 52. The streams, 56…" is corrected to read as -- ture for steams 53 and 52. The streams, 53… --.
Line 19, "temperature at the streams 56 …" is corrected to read as -- temperature at the streams 53 … --.

Column 8,
Line 67, "hydrocarbon carryover from 30 separation device 62 may be" is corrected to read as -- hydrocarbon carryover from the separation device 62 may be --.

Column 9,
Line 52, "denoted by numeral 122…" is corrected to read as -- denoted by numeral 102 --.

Signed and Sealed this

Twenty-seventh Day of September, 2005

JON W. DUDAS
*Director of the United States Patent and Trademark Office*